US012264889B2

(12) United States Patent
Ricci

(10) Patent No.: US 12,264,889 B2
(45) Date of Patent: Apr. 1, 2025

(54) SUPPRESSOR FOR A FIREARM

(71) Applicant: Replicator LLC, Westminster, CO (US)

(72) Inventor: Mario Ricci, Westminster, CO (US)

(73) Assignee: REPLICATOR LLC, Westminster, CO (US)

( * ) Notice: Subject to any disclaimer, the term of this patent is extended or adjusted under 35 U.S.C. 154(b) by 0 days.

(21) Appl. No.: 18/097,051

(22) Filed: Jan. 13, 2023

(65) Prior Publication Data

US 2024/0240896 A1 Jul. 18, 2024

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 6,308,609 B1 10/2001 Davies
8,196,701 B1 * 6/2012 Oliver ..... F41A 21/30 89/14.4
8,579,075 B2 11/2013 Brittingham et al.
8,967,325 B1 * 3/2015 Cronhelm ..... F41A 21/30 89/14.4
8,991,551 B2 * 3/2015 Latka ..... F41A 21/30 89/14.4
9,500,427 B1 * 11/2016 Larue ..... F41A 21/30
9,746,267 B2 8/2017 Smith
9,791,247 B2 10/2017 Parker
9,851,166 B2 12/2017 Petersen
10,126,084 B1 11/2018 Oglesby
10,228,210 B2 * 3/2019 Parker ..... F41A 21/30
10,330,418 B2 6/2019 Washburn, III et al.
10,393,463 B1 * 8/2019 Sanders ..... F41A 21/34
10,634,445 B1 * 4/2020 Klett ..... F41A 21/30
10,690,433 B2 6/2020 Oliver
10,753,699 B2 8/2020 Klett et al.
10,890,402 B2 1/2021 Orne et al.
(Continued)

FOREIGN PATENT DOCUMENTS

EP 3 294 691 B1 9/2020
RU 2 345 305 C2 1/2009
(Continued)

*Primary Examiner* — Joshua E Freeman
*Assistant Examiner* — Benjamin S Gomberg
(74) *Attorney, Agent, or Firm* — Kutak Rock LLP; Brian L. Main

(57) ABSTRACT

Disclosed herein are embodiments of a suppressor for a firearm, and methods of making and using such a suppressor, whereby the suppressor includes a body extending along a longitudinal axis between body proximal and distal ends, the body defined by an annular body wall; an inner chamber disposed within the body, the inner chamber defined by an annular inner chamber wall; an outer chamber disposed between the inner chamber wall and the body wall, the outer chamber radially surrounding the inner chamber; at least one inner chamber baffle disposed within the inner chamber; and at least one outer chamber baffle disposed within the outer chamber; wherein the inner and outer chamber baffles are configured to slow the rate of expansion of the firearm's propellant gases.

20 Claims, 12 Drawing Sheets

(56) References Cited

U.S. PATENT DOCUMENTS

| | | | | |
|---|---|---|---|---|
| 10,890,404 | B2 * | 1/2021 | Petersen | F41A 21/30 |
| 11,125,523 | B2 | 9/2021 | Petersen | |
| 11,162,753 | B2 | 11/2021 | Kras | |
| 11,255,623 | B2 | 2/2022 | Kras et al. | |
| 11,680,764 | B1 * | 6/2023 | Bray | F41A 21/32 181/223 |
| 11,703,303 | B1 * | 7/2023 | Bray | F41A 21/36 124/83 |
| 2013/0319790 | A1 * | 12/2013 | Bladen | F41A 21/30 181/223 |
| 2017/0160034 | A1 | 6/2017 | Parker | |
| 2017/0299313 | A1 * | 10/2017 | Adamson, Jr. | F41A 21/30 |
| 2018/0135932 | A1 * | 5/2018 | Tomczak | F41A 21/30 |
| 2019/0093973 | A1 * | 3/2019 | Hamby | F41A 21/30 |
| 2020/0025491 | A1 * | 1/2020 | Petersen | B33Y 80/00 |
| 2020/0025494 | A1 | 1/2020 | Parker | |
| 2020/0109907 | A1 * | 4/2020 | Klett | F41A 21/30 |
| 2020/0141679 | A1 * | 5/2020 | Garst | F41A 21/30 |
| 2021/0003360 | A1 * | 1/2021 | Kras | F41A 21/30 |
| 2021/0018287 | A1 * | 1/2021 | Kada | F41A 21/30 |
| 2021/0041200 | A1 * | 2/2021 | Kras | F41A 21/30 |
| 2021/0180902 | A1 * | 6/2021 | Bray | F41A 21/30 |
| 2021/0207916 | A1 | 7/2021 | Belykov et al. | |
| 2021/0239418 | A1 * | 8/2021 | Wilson | F41A 21/30 |
| 2021/0389072 | A1 * | 12/2021 | Bray | F41A 21/30 |
| 2022/0049920 | A1 * | 2/2022 | Kras | F41A 21/30 |
| 2022/0163281 | A1 * | 5/2022 | Madigan | F41A 21/30 |
| 2022/0170712 | A1 | 6/2022 | Engelbreit | |
| 2022/0214128 | A1 | 7/2022 | Petersen | |
| 2023/0417507 | A1 * | 12/2023 | Kras | F41A 21/34 |

FOREIGN PATENT DOCUMENTS

| | | |
|---|---|---|
| RU | 2 374 590 C2 | 11/2009 |
| RU | 2 437 048 C1 | 12/2011 |
| RU | 2 681 407 C1 | 3/2019 |
| RU | 2 703 919 C1 | 10/2019 |
| RU | 2 720 500 C2 | 4/2020 |
| RU | 2 745 462 C1 | 3/2021 |
| TW | 534975 | 6/2003 |
| WO | WO 99/46553 | 9/1999 |
| WO | WO 2016/126227 A1 | 8/2016 |
| WO | WO 2020/081268 A2 | 4/2020 |
| WO | WO 2020/123878 A1 | 6/2020 |

* cited by examiner

SUPPRESSOR FOR A FIREARM

I. BACKGROUND OF THE INVENTION

The discharge of a firearm can produce audible and visible signatures resulting from rapidly expanding propellant gases and the projectile leaving the muzzle at a velocity greater than the speed of sound with respect to ambient conditions, whereby attenuating these reports may be accomplished by slowing the rate of expansion of the propellant gases. However, by slowing said rate when a projectile is fired, a buildup of pressurized gas within the suppressor may occur, and a portion of this pressurized gas may flow through the barrel of the firearm and out towards the operator's face rather than following the tortuous path through the suppressor. Backpressure can also cause the action of the firearm to cycle more quickly and with more force, which may lead to wear and tear on the firearm and/or malfunctions. To address such challenges, it would be desirable to decrease the pressure buildup within the suppressor to thereby reduce or eliminate backflow into the firearm while effectively suppressing the audible and/or visual signature of the firearm.

I. SUMMARY OF THE INVENTION

A broad object of a particular embodiment of the invention can be to provide a suppressor for a firearm, and methods of making and using such a suppressor, whereby the suppressor includes a body extending along a longitudinal axis between body proximal and distal ends, the body defined by an annular body wall; an inner chamber disposed within the body, the inner chamber defined by an annular inner chamber wall; an outer chamber disposed between the inner chamber wall and the body wall, the outer chamber radially surrounding the inner chamber; at least one inner chamber baffle disposed within the inner chamber; and at least one outer chamber baffle disposed within the outer chamber; wherein the inner and outer chamber baffles are configured to slow the rate of expansion of the firearm's propellant gases.

II. A BRIEF DESCRIPTION OF THE DRAWINGS

III. DETAILED DESCRIPTION OF THE PREFERRED EMBODIMENTS

Figure 1A:
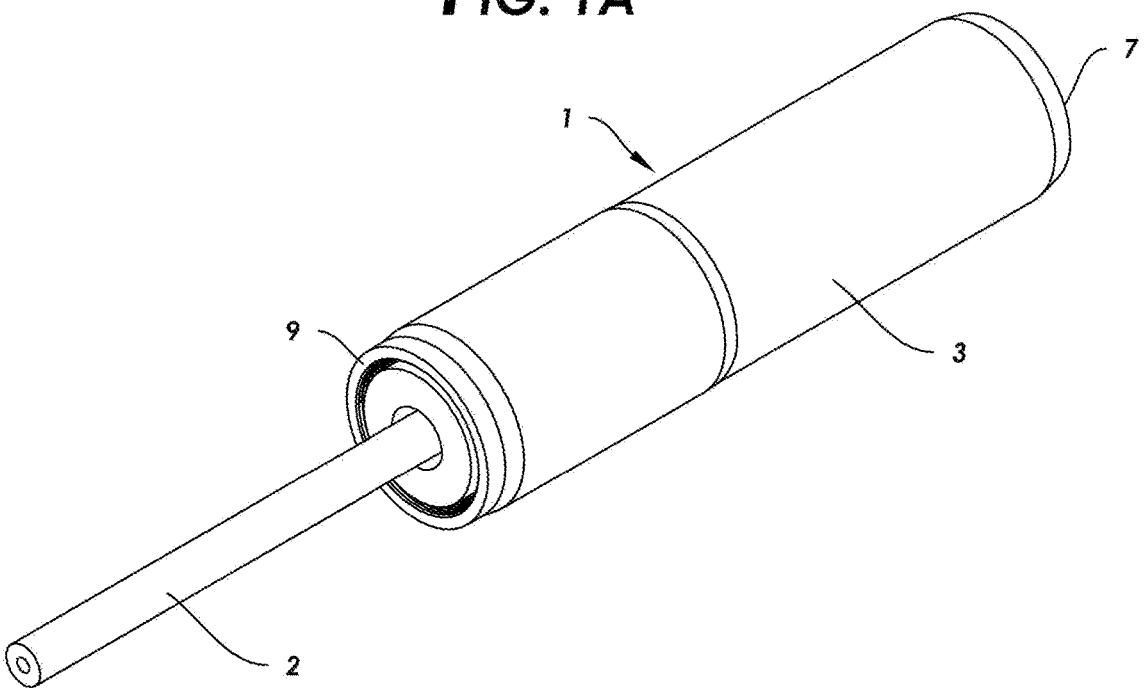
FIG. 1A is an illustration of a method of using a particular embodiment of the inventive suppressor, shown in a first perspective view, in combination with a barrel of a firearm to slow the rate of expansion of the firearm's propellant gases.
Figure 1B:
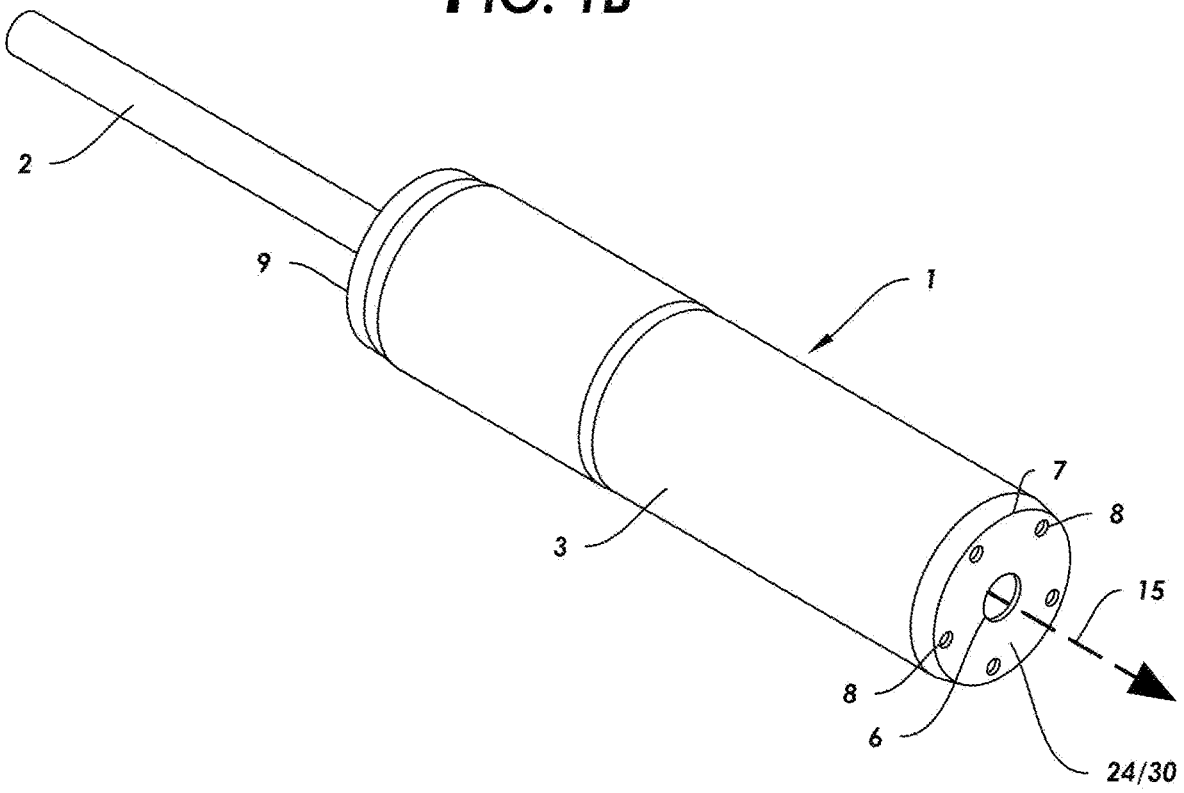
FIG. 1B is a second perspective view of the particular embodiment of the suppressor shown in FIG. 1A.

Now referring primarily to FIG. 1A and FIG. 1B, which illustrate a method of using a particular embodiment of the inventive suppressor (1) in combination with a firearm to lower the energy of propellant gases to reduce the energy signature(s) (audible signature and/or visible signature (flash)) of the propellant gases generated upon firing a projectile from the firearm while maintaining the desired ballistic performance. Further, the instant suppressor (1) can also reduce the backflow of propellant gases into the firearm after firing a projectile from the firearm.

Although generally referred to as a suppressor herein for consistency and ease of understanding the present disclosure, the instant suppressor (1) is not limited to that specific terminology and alternatively can be referred to as a silencer, sound attenuator, sound moderator, signature attenuator, or other terms.

As will be appreciated in light of the present disclosure, the instant suppressor (1) can be utilized with any of a wide variety of firearms (and projectile calibers), such as, but not limited to, semi-automatic pistols, bolt-action rifles, lever-action rifles, semi-automatic rifles, short-barreled rifles, long-range rifles, machine guns, submachine guns, or the like.

The instant suppressor (1), which can function to slow the expansion and release of pressurized propellant gases from the barrel (2) of a firearm, includes a body (3) that encloses an outer chamber (4) disposed about an inner chamber (5), whereby the suppressor (1) can be configured to direct a portion of the propellant gases through the inner chamber (5)

and, in tandem, direct another portion of the propellant gases through the outer chamber (4). The propellant gases flowing through the inner chamber (5) can follow a first tortuous path and subsequently vent to the environment through an inner chamber outlet (6) disposed proximate a body distal end (7) of the body (3), and the propellant gases flowing through the outer chamber (4) can follow a second tortuous path and subsequently vent to the environment through an outer chamber outlet (8) disposed proximate the body distal end (7).

Now referring primarily to FIG. 2A through FIG. 5, the body (3) of the suppressor (1) can extend along a longitudinal axis (or in an axial direction) between opposing body proximal and distal ends (9)(7), whereby the body (3) can be defined by an annular body wall (10). As to particular embodiments, the body (3) can have a substantially cylindrical shape with a substantially circular cross section. However, the body (3) need not be limited to this configuration, and other geometries may be acceptable, including a cross-sectional shape that is hexagonal, octagonal, rectangular, oval, or elliptical, for example.

As used herein, the terms "longitudinal" and "axial" and "axial direction" mean a direction substantially parallel to the barrel (2) of a firearm.

As used herein, the terms "radial" and "radial direction" mean a direction oriented transversely (or orthogonally or perpendicularly) to the longitudinal axis of the body (3) along a radius of the body (3).

As used herein, a "distal direction" or "distally" means toward the body distal end (7) along the longitudinal axis of the body (3), as opposed to toward the body proximal end (9). Correspondingly, as used herein, a "proximal direction" or "proximally" means toward the body proximal end (9) along the longitudinal axis of the body (3), as opposed to toward the body distal end (7). In relation to a firearm, the body proximal end (9) couples to the muzzle of the barrel (2).

Regarding dimensions, as but one illustrative example, the body (3) can have an axial body length (11) (which can be parallel with the longitudinal axis) of about 3.25 inches to about 13 inches, such as about 6.5 inches. As but one illustrative example, the body (3) can have a body width (12) (or diameter) of about 0.8 inches to about 3.2 inches, such as about 1.6 inches.

Figure 2A:
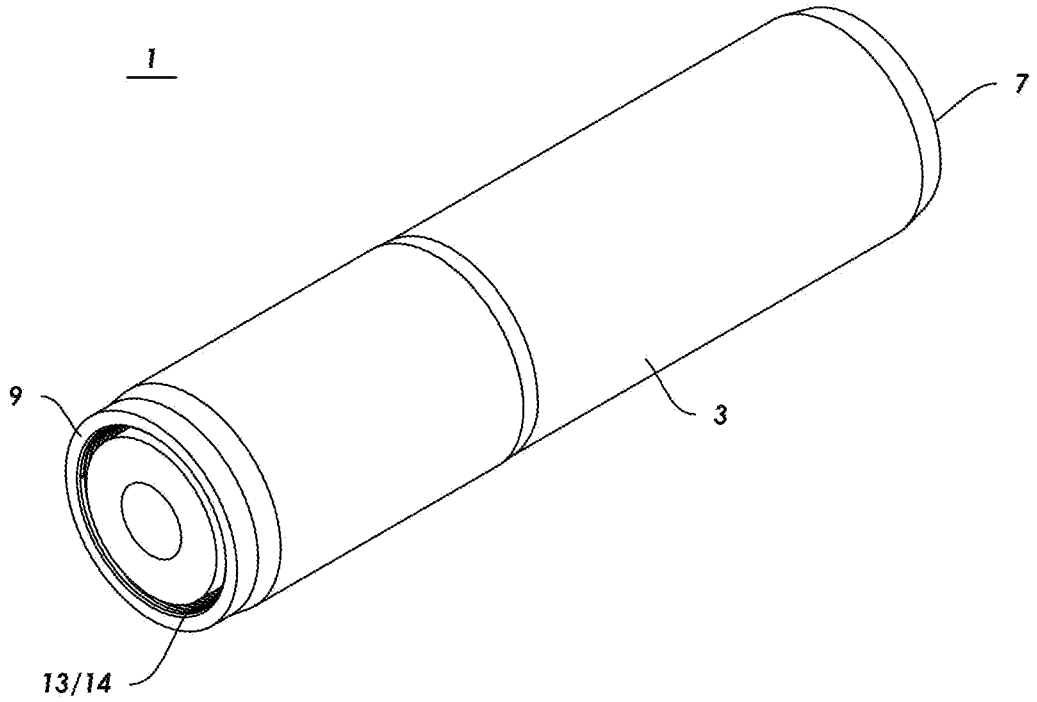
FIG. 2A is a first perspective view of a particular embodiment of the inventive suppressor.
Figure 2B:
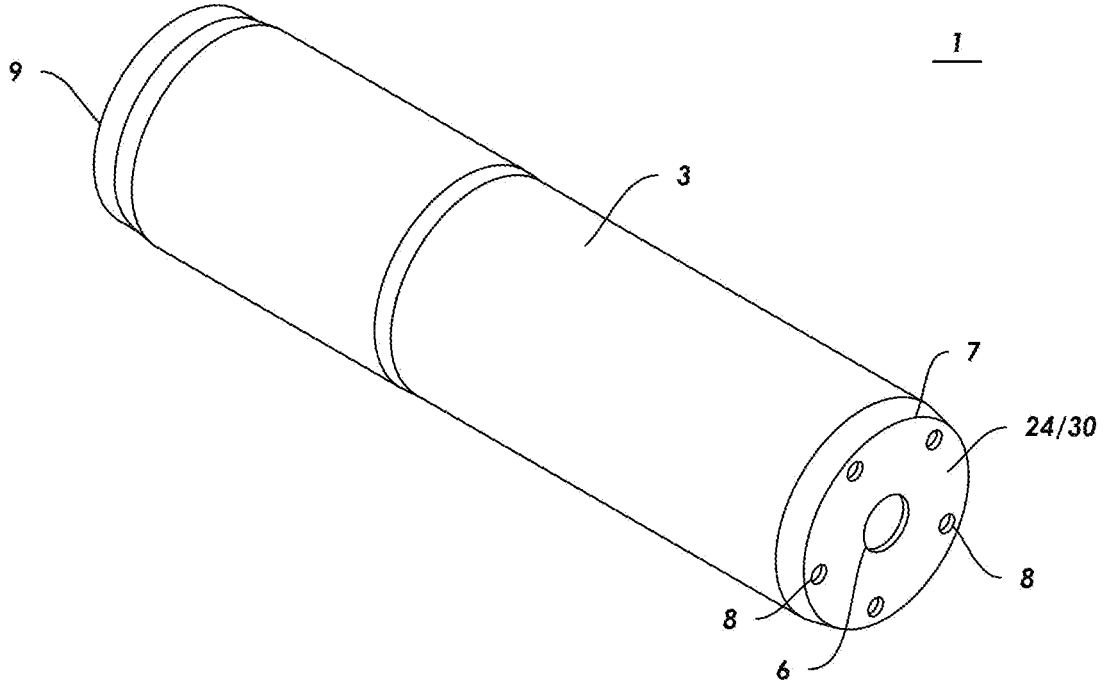
FIG. 2B is a second perspective view of the particular embodiment of the suppressor shown in FIG. 2A.
Figure 3A:
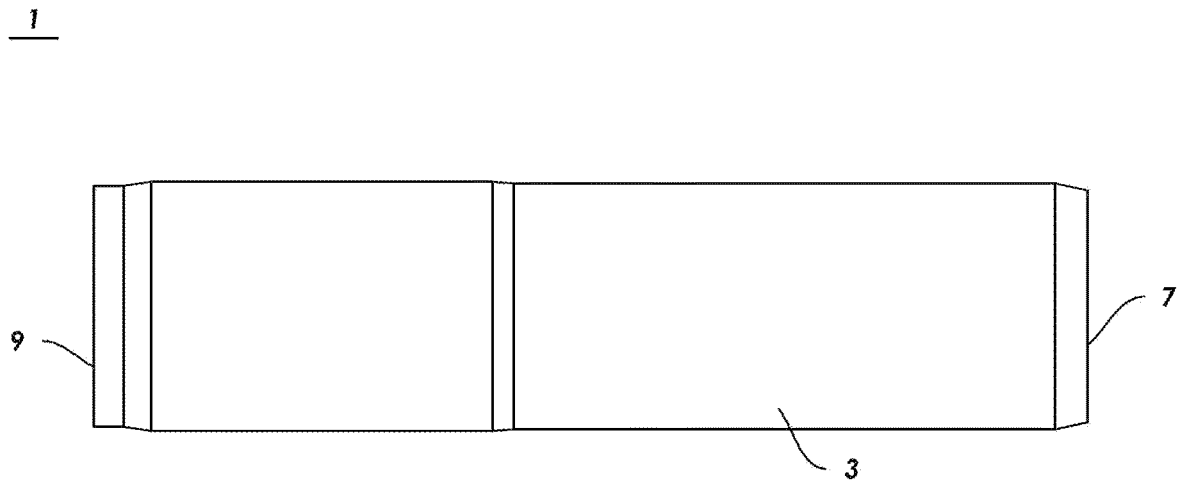
FIG. 3A is a front or rear or first side or second side view of the particular embodiment of the suppressor shown in FIG. 2A.
Figure 3B:
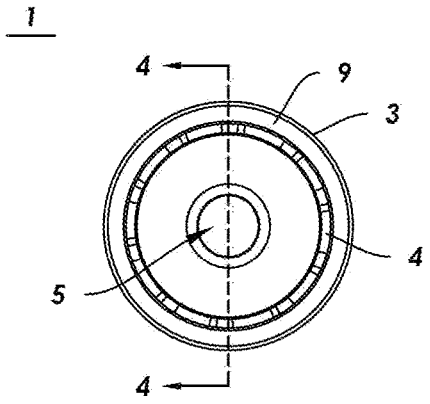
FIG. 3B is a first end view of the particular embodiment of the suppressor shown in FIG. 3A.
Figure 3C:
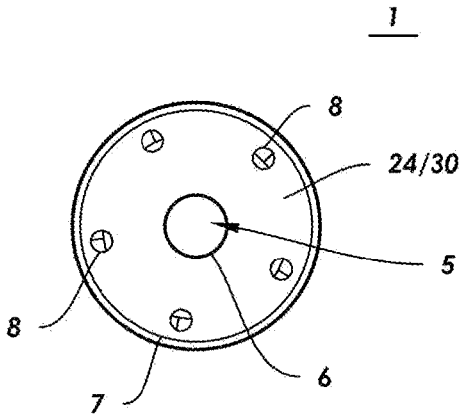
FIG. 3C is a second end view of the particular embodiment of the suppressor shown in FIG. 3A.
Figure 4:
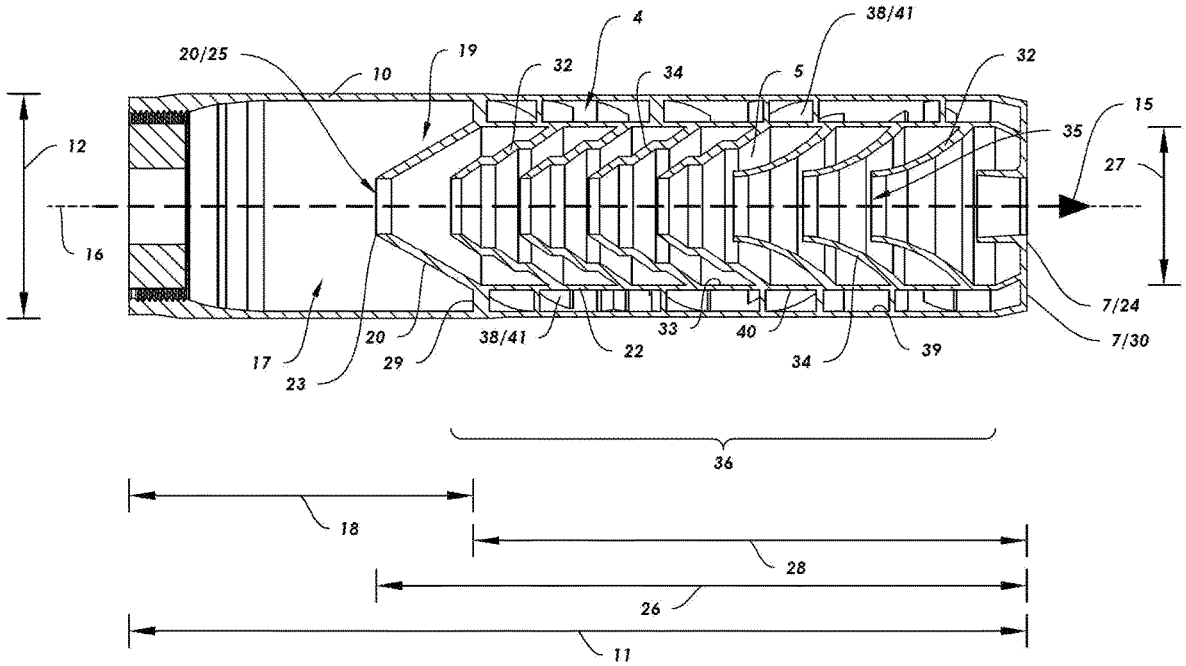
FIG. 4 is a cross-sectional view 4-4 of the particular embodiment of the suppressor shown in FIG. 3B.
Figure 5:
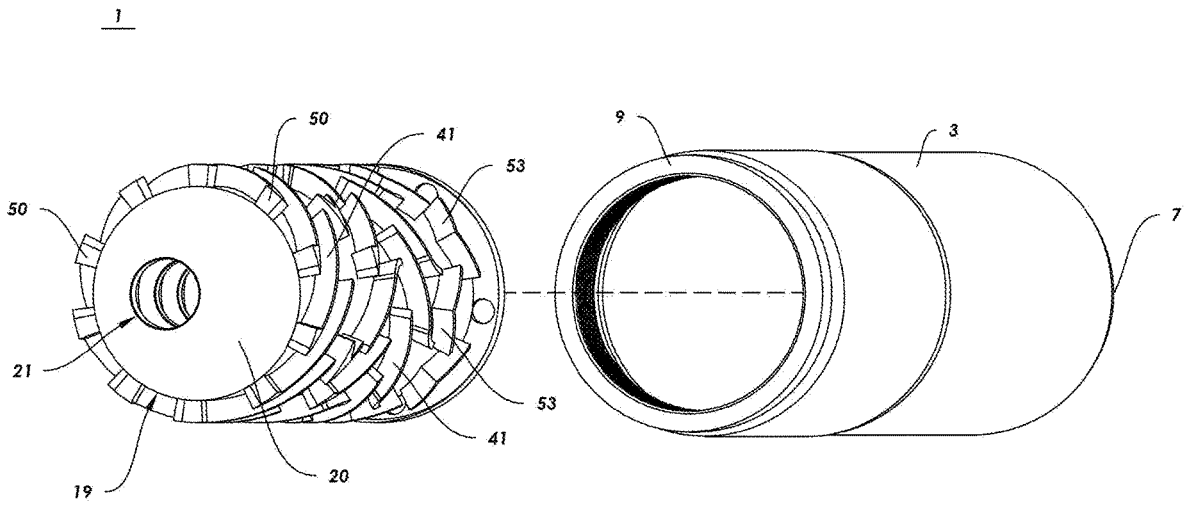
FIG. 5 is an exploded view of the particular embodiment of the suppressor shown in FIG. 3A, whereby the body is exploded from an internal portion of the suppressor.

Now referring primarily to FIG. 2A and FIG. 4, the suppressor (1) can further include a mount (13) coupled to, connected to, or integrated with the body (3) proximate the body proximal end (9), whereby the mount (13) can be configured to couple or connect the suppressor (1) to the barrel (2) of a firearm. As to particular embodiments, the mount (13) can be configured for direct connection of the suppressor (1) to the barrel (2) of a firearm; as to other particular embodiments, the mount (13) can be configured to receive a muzzle attachment, adapter, quick-disconnect assembly, etc. (not shown) which permits indirect connection of the suppressor (1) to the barrel (2) of a firearm. As but one illustrative example, the mount (13) can comprise a threaded portion (14) which facilitates the above direct or indirect connection. Of course, other connection methodologies are envisioned for securing the suppressor (1) to the barrel (2) of a firearm.

Now referring primarily to FIG. 4, the suppressor (1) can further include a projectile pathway (15) axially extending through the body (3) between the body proximal and distal ends (9)(7), whereby the projectile pathway (15) can be sized to accommodate a firearm projectile. As to particular embodiments, the projectile pathway (15) can extend through the body (3) along a central longitudinal axis (16) of the body (3) or can be coaxially aligned with the central longitudinal axis (16).

Again referring primarily to FIG. 4, the suppressor (1) can further include a blast chamber (17) disposed (or enclosed) within the body (3), such as along the central longitudinal axis (16) or coaxially aligned with the central longitudinal axis (16), proximate or adjacent to the body proximal end (9), whereby the blast chamber (17) can be a relatively voluminous and open area which allows the propellant gases to initially expand upon entering the suppressor (1) from the smaller diameter bore of the barrel (2) of a firearm. Regarding dimensions, as but one illustrative example, the blast chamber (17) can have an axial blast chamber length (18) of about 0.925 inches to about 3.7 inches to accommodate a varying number of muzzle devices. As to particular embodiments, the blast chamber length (18) can be about 1.85 inches.

Now referring primarily to FIG. 4 through FIG. 6E, the suppressor (1) can further include a diverter (19) disposed within the body (3), such as along the central longitudinal axis (16), proximate the body proximal end (9), whereby the diverter (19) can include a diverter wall (20) with a diverter bore (21) axially extending therethrough. The diverter bore (21) can be coaxially aligned with the central longitudinal axis (16) such that the projectile pathway (15) extends therethrough.

Spatially, the diverter (19) can be disposed in a distal direction from the blast chamber (17) and in a proximal direction from the inner and outer chambers (5)(4) or, said another way, the diverter (19) can be located between the blast chamber (17) and the inner and outer chambers (5)(4). The diverter bore (21) can communicate with the blast chamber (17) and the inner chamber (5), thus allowing the projectile and a portion of the propellant gases to enter the inner chamber (5) from the blast chamber (17), whereas the diverter wall (20) can direct a portion of the propellant gases radially outward from the diverter bore (21) and into the outer chamber (4). Following, as the propellant gases enter the suppressor (1) from the barrel (2) of a firearm, the diverter (19) can divide the flow of the propellant gases into two separate volumes.

As to particular embodiments, the diverter (19) can direct a significant portion of the propellant gases to flow through the outer chamber (4), with the remainder of the propellant gases entering and flowing through the inner chamber (5).

As to particular embodiments, the diverter (19) can direct at least about 25% of the propellant gases to the outer chamber (4).

As to particular embodiments, the diverter (19) can direct at least about 30% of the propellant gases to the outer chamber (4).

As to particular embodiments, the diverter (19) can direct at least about 35% of the propellant gases to the outer chamber (4).

As to particular embodiments, the diverter (19) can direct at least about 40% of the propellant gases to the outer chamber (4).

As to particular embodiments, the diverter (19) can direct at least about 45% of the propellant gases to the outer chamber (4).

As to particular embodiments, the diverter (19) can direct at least about 50% of the propellant gases to the outer chamber (4).

As to particular embodiments, the diverter (19) can direct at least about 55% of the propellant gases to the outer chamber (4).

As to particular embodiments, the diverter (19) can direct at least about 60% of the propellant gases to the outer chamber (4).

As to particular embodiments, the diverter (19) can direct at least about 65% of the propellant gases to the outer chamber (4).

As to particular embodiments, the diverter (19) can direct at least about 70% of the propellant gases to the outer chamber (4).

As to particular embodiments, the diverter (19) can direct at least about 75% of the propellant gases to the outer chamber (4).

As to particular embodiments, the diverter (19) can be conical; for example, the diverter (19) can be configured as a truncated cone or can have a frustoconical geometry. Thus, the diverter wall (20) can radially expand as it extends distally from the diverter bore (21). Said another way, the diverter wall (20) can dispose in angled relation to the longitudinal axis and flare in a distal direction, thereby having a smaller proximal diameter about the diverter bore (21) which flares into a larger distal diameter.

While the diverter (19) may be shown as having a flared diverter wall (20) with a single flare, it is herein contemplated that the flared diverter wall (20) could have a combination of flared and vertical sections or a combination of vertical and horizontal/cylindrical sections with a stepped profile, for example. Similarly, while the flared diverter wall (20) may be shown as having a linear flare, it is herein contemplated that the flare could also be non-linear (or arcuate or curved) or include sections with a non-linear flare.

Figure 10:
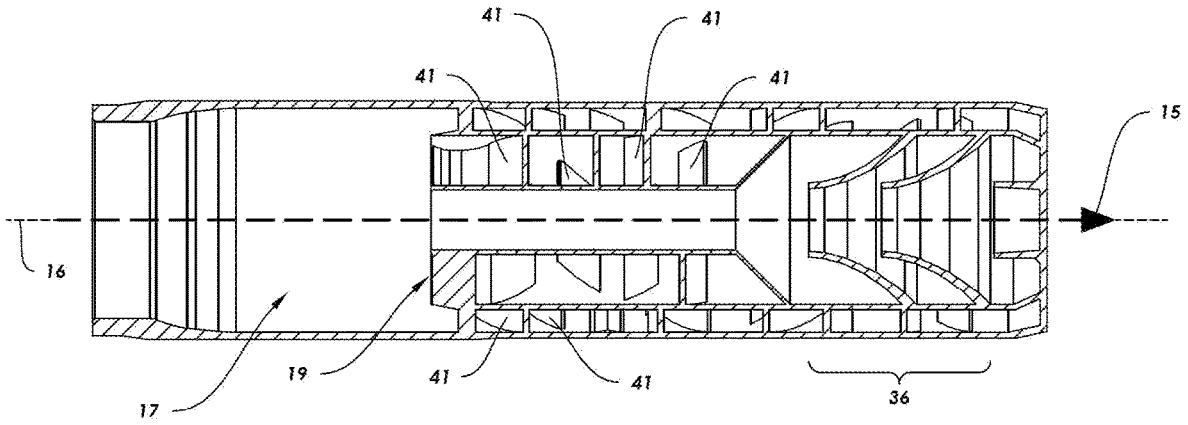
FIG. 10 is a cross-sectional view of a particular embodiment of the inventive suppressor.

As to other particular embodiments, as opposed to flaring, the diverter wall (20) can dispose in substantially transverse (or orthogonal or perpendicular) relation to the longitudinal axis (as shown in the example of FIG. 10).

Now referring primarily to FIG. 4, the suppressor (1) can further include an inner chamber (5) disposed (or enclosed) within the body (3), such as along the central longitudinal axis (16) or coaxially aligned with the central longitudinal axis (16), whereby the inner chamber (5) can be defined by an annular inner chamber wall (22) extending between an inner chamber proximal end (23) (oriented toward the body proximal end (9)) and an inner chamber distal end (24) (oriented toward the body distal end (7)). The projectile pathway (15) can axially extend through the inner chamber (5) between the inner chamber proximal and distal ends (23)(24), such as along the central longitudinal axis (16) or can be coaxially aligned with the central longitudinal axis (16). Along the projectile pathway (15), the inner chamber proximal end (23) can include an inner chamber inlet (25) configured to allow a projectile and propellant gases from the barrel (2) of a firearm to pass therethrough to enter the inner chamber (5), and the inner chamber distal end (24) can include a corresponding inner chamber outlet (6) configured to allow the projectile and propellant gases to pass therethrough to exit the inner chamber (5) and the suppressor (1).

The inner chamber (5) can be disposed in a distal direction from the diverter (19), whereby the diverter bore (21) can communicate with the inner chamber inlet (25) or, as to particular embodiments, the diverter bore (21) can be coincident with and/or provide the inner chamber inlet (25).

Regarding dimensions, the inner chamber (5) can have an axial inner chamber length (26) and an inner chamber width (27) (or diameter) which facilitates disposition within the body (3) distally from the blast chamber (17).

Again referring primarily to FIG. 4, the suppressor (1) can further include an outer chamber (4) disposed (or enclosed) within the body (3) with an outer chamber length (28) extending between an outer chamber proximal end (29) (oriented toward the body proximal end (9)) and an outer chamber distal end (30) (oriented toward the body distal end (7)). In particular, the outer chamber (4) can be disposed between the inner chamber wall (22) and the body wall (10) such that the outer chamber (4) radially surrounds (either partially or entirely) the inner chamber (5), thus providing an annular space between the inner chamber wall (22) and the body wall (10). As to particular embodiments, the outer chamber (4) can be coaxially disposed about and/or concentric with the inner chamber (5).

The outer chamber proximal end (29) can include one or more outer chamber inlets (31) configured to allow propellant gases from the barrel (2) of a firearm to pass therethrough to enter the outer chamber (4), whereby the outer chamber inlet(s) (31) can be disposed radially about or extend circumferentially about the inner chamber (5). The outer chamber (4) can be disposed in a distal direction from the diverter (19); accordingly, the diverter wall (20) can direct a portion of the propellant gases radially outward from the diverter bore (21) for passage through the outer chamber inlet (31) to enter the outer chamber (4).

The outer chamber distal end (30) can include a corresponding outer chamber outlet (8) configured to allow the propellant gases to pass therethrough to exit the outer chamber (4) and the suppressor (1), thereby venting to the environment. As to particular embodiments, the outer chamber outlet (8) can be configured as one or more vents or apertures axially disposed within the body distal end (7) in circumferentially spaced-apart relation, whereby the apertures can be concentric about and/or radially outside of the inner chamber outlet (6). As to other particular embodiments, the outer chamber outlet (8) can be configured as one or more apertures radially disposed within the body distal end (7) in circumferentially spaced-apart relation (not shown).

The apertures can be symmetrically or asymmetrically arranged about the inner chamber outlet (6) and can have any of a wide variety of shapes, including circular, oval, slot, polygonal, or other suitable configuration.

As to particular embodiments, the outer chamber (4) can be completely fluidically isolated from the inner chamber (5) along their lengths by the inner chamber wall (22), meaning propellant gases cannot flow radially therebetween. As such, the inner chamber (5) and the outer chamber (4) can, in tandem, independently evacuate propellant gases to the environment via the inner chamber outlet (6) and the outer chamber outlet (8), respectively. As to these particular embodiments, there can be no fluid communication between the inner and outer chambers (5)(4) along their lengths (26)(28), which may be in contrast to suppressors having exchange openings between inner and outer chambers.

As to particular embodiments, the suppressor (1) can include or consist of only one inner chamber (5) and only one outer chamber (4).

Now referring primarily to FIG. 4 through FIG. 8, the suppressor (1) can further include baffles disposed within the inner and outer chambers (5)(4), whereby as used herein, the term "baffle" means a structure which can obstruct the flow of propellant gases (and/or sound waves and/or pressure waves) and/or direct the flow of said gases into vortices or other flow patterns, for example to increase the length of the gas flow path as the propellant gases travel distally through the inner and outer chambers (5)(4), thereby allowing said propellant gases to cool and further expand in said inner and outer chambers (5)(4). For example, the baffles can preclude a direct linear path through the inner or outer chamber (5)(4), accordingly requiring the propellant gases to take a non-linear or tortuous or serpentine path as they flow distally therethrough to the respective inner or outer chamber outlet (6)(8). In this way, the baffles can slow down gas expansion and delay venting from the suppressor (1). Additionally, upon collision with a baffle, turbulence can be induced, correspondingly resulting in energy dissipation and a reduction in the pressure and temperature of the propellant gases; consequently, the suppressor (1) can decrease the backflow of propellant gases into the firearm and lessen the audible signature and/or visible signature of the propellant gases.

Now referring primarily to FIG. 4, the inner chamber (5) can include one or a plurality, whether the same or different, of inner chamber baffles (32) disposed therein between the projectile pathway (15) and the inner chamber wall (22), whereby an inner chamber baffle (32) can have any of a wide variety of shapes that promote gas expansion and provide a tortuous path for the propellant gases, thereby inducing turbulence and energy dissipation within the inner chamber (5).

As to particular embodiments, an inner chamber baffle (32) can radially inwardly extend from the inner chamber wall (22) and in particular, from an inner chamber wall inner surface (33). As to particular embodiments, an inner chamber baffle (32) can extend only partially between the inner chamber wall (22) and the projectile pathway (15). As to other particular embodiments, an inner chamber baffle (32) can extend entirely or completely between the inner chamber wall (22) and the projectile pathway (15).

As to particular embodiments, the inner chamber baffle (32) can be conical; for example, the inner chamber baffle (32) can be configured as a truncated cone or can have a frustoconical geometry. Thus, an inner chamber baffle wall (34) can radially expand as it extends distally from an inner chamber baffle bore (35) which can be coaxially aligned with the central longitudinal axis (16) such that the projectile pathway (15) extends therethrough. Said another way, the inner chamber baffle wall (34) can dispose in angled relation to the longitudinal axis and flare in a distal direction, thereby having a smaller proximal diameter about the inner chamber baffle bore (35) which flares into a larger distal diameter.

As to particular embodiments, the inner chamber baffle (32) can have a flared inner chamber baffle wall (34) with a single flare. As to other particular embodiments, the flared inner chamber baffle wall (34) can have a combination of flared and vertical sections or a combination of vertical and horizontal/cylindrical sections with a stepped profile, for example.

As to particular embodiments, the flared inner chamber baffle wall (34) can have a linear flare (not shown). As to other particular embodiments, the flare can be non-linear (or arcuate or curved) or include sections with a non-linear flare.

As to particular embodiments, an inner chamber baffle (32) can be configured as an "M-baffle," a "K baffle," an "Omega baffle," or the like.

Again referring primarily to FIG. 4, the inner chamber (5) can include a baffle stack (36) formed from a plurality of individual inner chamber baffles (32), such as conical baffles, arranged end to end and having their inner chamber baffle bores (35) oriented along the central longitudinal axis (16), whereby the baffle stack (36) can partition the inner chamber (5) into compartments between adjacent inner chamber baffles (32). As to these particular embodiments, an inner chamber baffle wall (34) can radially extend from its inner chamber baffle bore (35) to the inner chamber wall (22) and in particular, to the inner chamber wall inner surface (33). As to particular embodiments, an inner chamber baffle wall (34) can be coupled to or continuous with the inner chamber wall (22) or said another way, a cylindrical body of an inner chamber baffle (32) can connect to the body of adjacent inner chamber baffles (32) to define the inner chamber wall (22).

As to particular embodiments, all inner chamber baffles (32) in a baffle stack (36) can have substantially the same geometry. As to other particular embodiments, the geometry of one or more inner chamber baffles (32) in a baffle stack (36) can differ from the geometry of one or more of the other inner chamber baffles (32) in the baffle stack (36).

As to particular embodiments, the spacing between inner chamber baffles (32) in a baffle stack (36) can be the same. As to other particular embodiments, the spacing between inner chamber baffles (32) in a baffle stack (36) can be different.

Now referring primarily to FIG. 4 through FIG. 8, the outer chamber (4) can include a plurality of outer chamber baffles (38) disposed therein between the inner chamber wall (22) and the body wall (10), whereby the outer chamber baffles (38) can promote gas expansion and provide a tortuous path for the propellant gases, thereby inducing turbulence and energy dissipation within the outer chamber (4).

As to particular embodiments, an outer chamber baffle (38) can radially inwardly extend from the body wall (10) and in particular, from a body wall inner surface (39). As to other particular embodiments, an outer chamber baffle (38) can radially outwardly extend from the inner chamber wall (22) and in particular, from an inner chamber wall outer surface (40).

As to particular embodiments, an outer chamber baffle (38) can extend only partially between the inner chamber wall (22) and the body wall (10); following, the outer chamber baffle (38) can be connected to or integrated with one of the inner chamber wall (22) or the body wall (10). As to other particular embodiments, an outer chamber baffle (38) can extend entirely or completely between the inner chamber wall (22) and the body wall (10); hence, the outer chamber baffle (38) can be connected to or integrated with both of the inner chamber wall (22) and the body wall (10).

An outer chamber baffle (38) can have any of a wide variety of configurations in any number of orientations that can induce turbulence and energy dissipation within the outer chamber (4).

Again referring primarily to FIG. 4 through FIG. 8, as to particular embodiments, an outer chamber baffle (38) can be configured as a protrusion or rib (41) disposed between the inner chamber wall (22) and the body wall (10). A rib (41) can have a rib height (42) which radially extends, whether partially or completely, between the inner chamber wall (22) and the body wall (10), whereby the rib height (42) can be constant along a rib length (43), vary along the rib length (43), be constant along a rib width (44), or vary along the rib width (44), depending upon the embodiment.

Further, a rib (41) can have a rib length (43) extending between a rib proximal end (45) (oriented toward the outer chamber proximal end (29)) and a rib distal end (46) (oriented toward the outer chamber distal end (30)), whereby the rib length (43) extends helically about the longitudinal axis within the outer chamber (4). Said another way, the rib length (43) extends helically within the annular space provided by the outer chamber (4) between the outer chamber proximal and distal ends (29)(30). The helical extension means that the rib length (43) extends both circumferentially and axially within the outer chamber (4) between the outer chamber proximal and distal ends (29)(30).

Regarding the circumferential extension within the outer chamber (4), such as about the inner chamber wall (22) or the inner chamber wall outer surface (40), between the outer chamber proximal and distal ends (29)(30), as to particular embodiments, the rib length (43) can extend only partially about or about only a portion of the circumference of the inner chamber wall (22), meaning that the rib length (43) does not extend about the entire 360° circumferential span of the inner chamber wall (22).

As to particular embodiments, the rib length (43) can span less than 360° of the circumference of the inner chamber wall (22).

As to particular embodiments, the rib length (43) can span not greater than about 300° of the circumference of the inner chamber wall (22).

As to particular embodiments, the rib length (43) can span not greater than about 240° of the circumference of the inner chamber wall (22).

As to particular embodiments, the rib length (43) can span not greater than about 180° of the circumference of the inner chamber wall (22).

As to particular embodiments, the rib length (43) can span not greater than about 120° of the circumference of the inner chamber wall (22).

As to particular embodiments, the rib length (43) can span not greater than about 60° of the circumference of the inner chamber wall (22).

As to particular embodiments, the rib length (43) can extend only partially along or along only a portion of the outer chamber length (28), meaning that the rib length (43) does not extend along the entire outer chamber length (28).

As to particular embodiments, the rib length (43) can extend along less than 100% of the outer chamber length (28).

As to particular embodiments, the rib length (43) can extend along not greater than about 80% of the outer chamber length (28).

As to particular embodiments, the rib length (43) can extend along not greater than about 60% of the outer chamber length (28).

As to particular embodiments, the rib length (43) can extend along not greater than about 40% of the outer chamber length (28).

As to particular embodiments, the rib length (43) can extend along not greater than about 25% of the outer chamber length (28).

As to particular embodiments, the rib length (43) can extend along not greater than about 20% of the outer chamber length (28).

As to particular embodiments, the rib length (43) can extend along not greater than about 15% of the outer chamber length (28).

As to particular embodiments, the rib length (43) can extend along not greater than about 10% of the outer chamber length (28).

The rib length (43) can be constant along the rib height (42), vary along the rib height (42), be constant along the rib width (44), or vary along the rib width (44), depending upon the embodiment.

As to particular embodiments, the rib length (43) can be entirely linear between the rib proximal and distal ends (45)(46) (as shown in FIGS. 7A, 7B, 7D, and 8). As to other particular embodiments, the rib length (43) can be entirely non-linear (or arcuate or curved) between the rib proximal and distal ends (45)(46) (not shown).

Figure 7A:
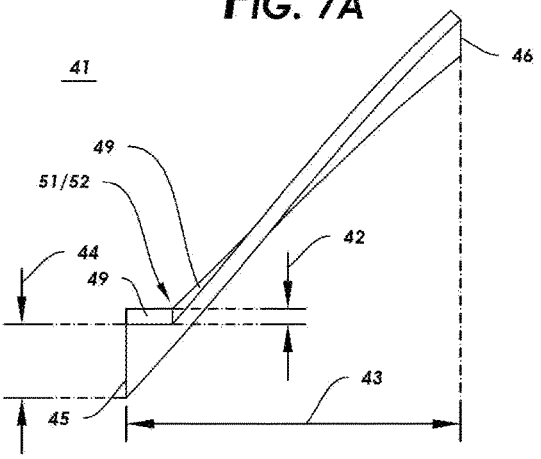
FIG. 7A is a view of a particular embodiment of a rib of the internal portion of the suppressor shown in FIG. 5.
Figure 7B:
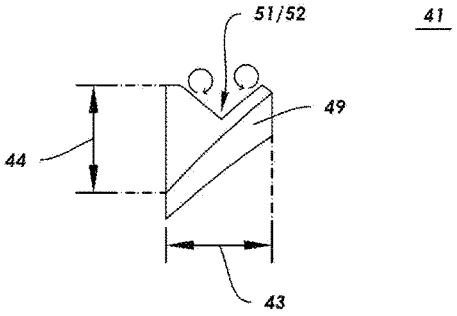
FIG. 7B is a view of a particular embodiment of a rib of the internal portion of the suppressor shown in FIG. 5.
Figure 7C:
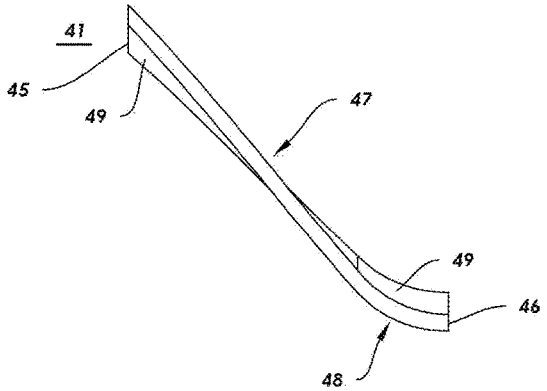
FIG. 7C is a view of a particular embodiment of a rib of the internal portion of the suppressor shown in FIG. 5.
Figure 8:
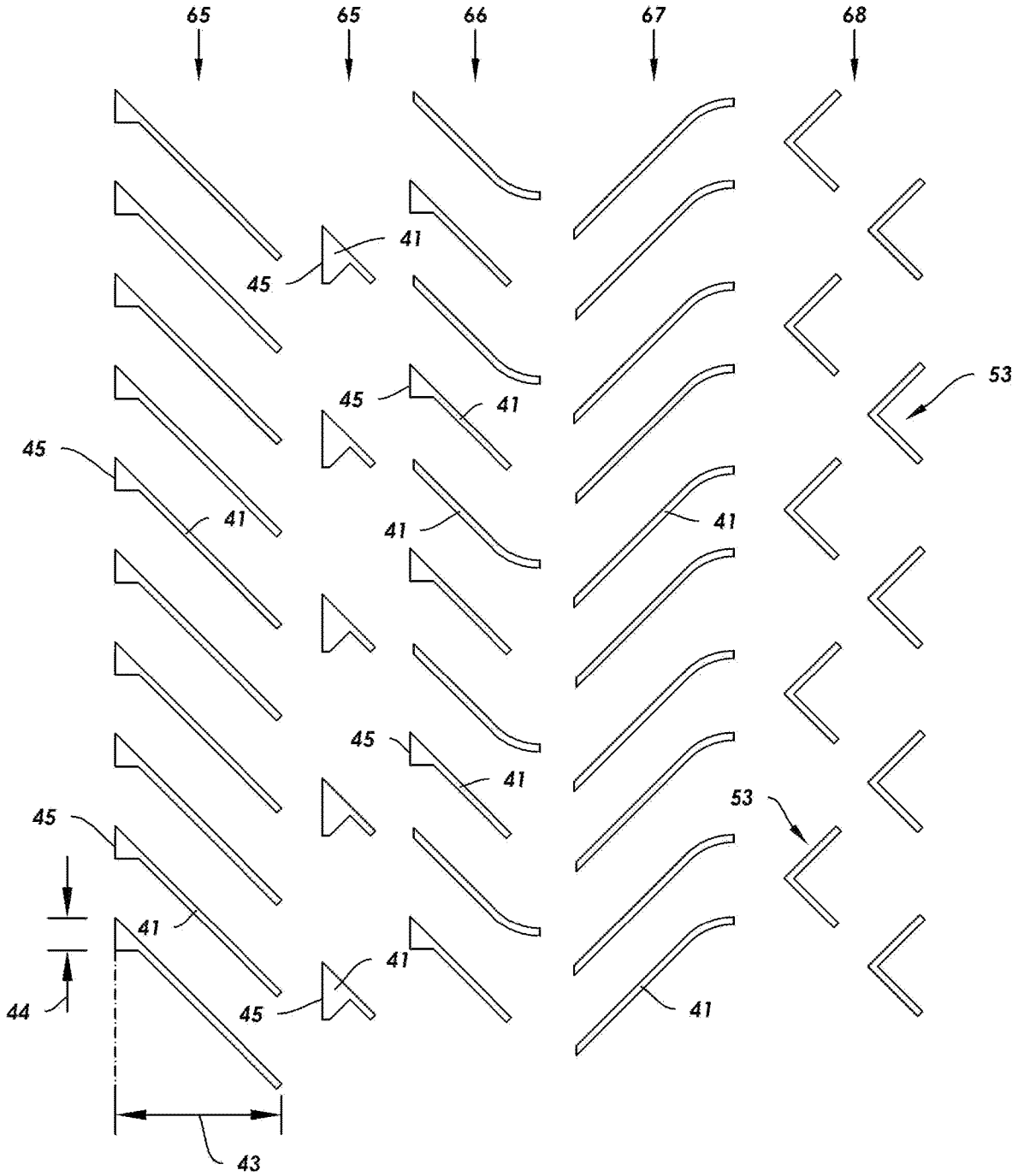
FIG. 8 is an unwrapped view of the five circumferential rib arrays of the internal portion of the suppressor shown in FIG. 5.

As to yet other particular embodiments, the rib length (43) can comprise linear and non-linear portions between the rib proximal and distal ends (45)(46) (as shown in FIGS. 7C and 8). As but one illustrative percent, about 75% of the rib length (43) can be linear and about 25% of the rib length (43) can be non-linear. Of course, other percentage splits are herein contemplated. Concerning orientation, as to particular embodiments, the linear portion (47) can be proximate and/or incorporated into the rib proximal end (45), and the non-linear portion (48) can be proximate and/or incorporated into the rib distal end (46).

A rib (41) can have a rib width (44) extending between rib lateral faces (49), the rib width (44) connecting the rib length (43) and the rib height (42), whereby the rib width (44) can be constant along the rib length (43), vary along the rib length (43), be constant along the rib height (42), or vary along the rib height (42), depending upon the embodiment.

Now referring primarily to FIGS. 7A, 7B, and 8, as to particular embodiments, a rib (41) can have a rib width (44) which varies along the rib length (43). As but one illustrative example, the rib width (44) can be greater proximate the rib proximal end (45) (which can be configured as a rib proximal end face (50)) and lesser proximate the rib distal end (46). As but one illustrative example, the rib proximal end face (50) can have a greater width than the remainder of the rib (41).

Now referring primarily to FIG. 6A through FIG. 6H, as to particular embodiments, the rib proximal end face (50) can be disposed in angled relation to (meaning not parallel to) the longitudinal axis to induce turbulence in the propellant gases as they flow distally through the outer chamber (4).

Again referring primarily to FIG. 6A through FIG. 6H, as to particular embodiments, the rib proximal end face (50) can be disposed in transverse (or orthogonal or perpendicular) relation to the longitudinal axis to induce turbulence in the propellant gases as they flow distally through the outer chamber (4).

Although the Figures illustrate helical ribs (41) having a rectangular cross-section, any suitable cross-section can be used.

Now referring primarily to FIGS. 7A, 7B, 7D, and 8, as to particular embodiments, a rib (41) can include a vortex generator (51) which can be configured as two adjacent faces of the rib (41) disposed in angled relation to one another to create a vortex-generating pocket (52) therebetween, whereby the angle can be less than 180°, between about 90° and 180°, about 90°, or less than about 90°, depending upon the embodiment. As to particular embodiments, the vortex generator (51) can be integrated with the rib (41).

As to particular embodiments, the vortex generator (51) can be disposed in a rib lateral face (49), such as proximate the rib proximal end (45).

Now referring primarily to FIG. 7A and FIG. 7B, geometrically, as but one illustrative example of a rib (41) having (i) a rib proximal end face (50) with a greater rib width (44) than the remainder of the rib (41) and (ii) including a vortex generator (51) proximate the rib proximal end (45), the rib proximal end (45) can be configured as a three-dimensional (3D) polygon having sides including the rib proximal end face (50) and the two rib lateral faces (49), whereby one of the rib lateral faces (49) comprises two adjacent face portions disposed in angled relation to one another to create a vortex-generating pocket (52) therebetween. As but one more specific example, the rib proximal end (45) can be configured as a triangular prism having sides including the rib proximal end face (50) and the two rib lateral faces (49).

Concerning the various features of an instant rib (41) described above, an individual rib (41) can include only one of the features of a combination of the features, depending upon the embodiment.

Now referring primarily to FIG. 6A through FIG. 6H, as to particular embodiments, a rib (41) can helically extend about the longitudinal axis in a clockwise direction. As to other particular embodiments, a rib (41) can helically extend about the longitudinal axis in a counterclockwise direction.

Figure 7D:
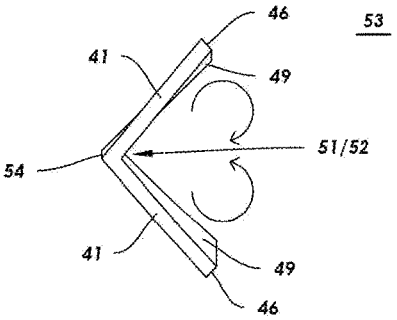
FIG. 7D is a view of a particular embodiment of a rib of the internal portion of the suppressor shown in FIG. 5.

Now referring primarily to FIG. 7D and FIG. 8, as to particular embodiments, a rib (41) can be configured as a pair of diverging ribs (53) such that the rib ends, for example the rib proximal ends (45), of circumferentially adjacent ribs can be directed toward each other to converge, such as at a vertex (54), and make a V shape which can be oriented generally parallel to the longitudinal axis and points proximally, whereby the rib proximal ends (45) may or may not contact each other, depending upon the embodiment.

As the pair of diverging ribs (53) provides two adjacent faces of the rib (41) disposed in angled relation to one another, the pair of diverging ribs (53) can define a vortex-generating pocket (52) and thus, the pair of diverging ribs (53) can include a vortex generator (51).

Figure 6A:
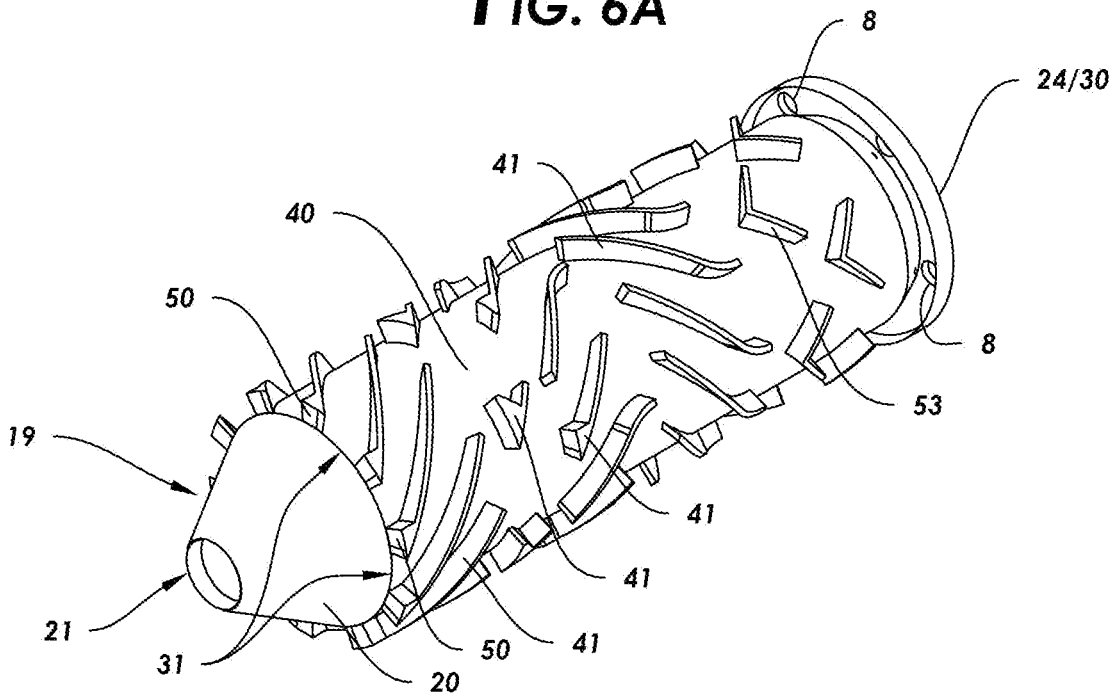
FIG. 6A is a first perspective view of the internal portion of the particular embodiment of the suppressor shown in FIG. 5.
Figure 6B:
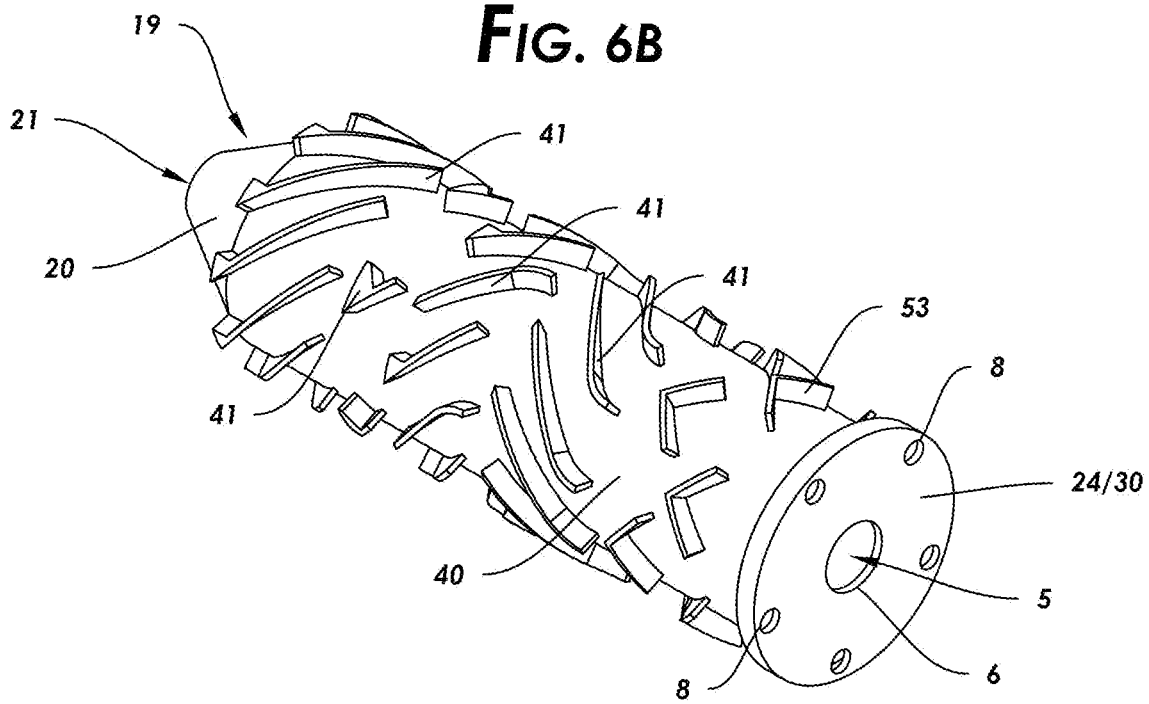
FIG. 6B is a second perspective view of the internal portion of the particular embodiment of the suppressor shown in FIG. 5.
Figure 6C:
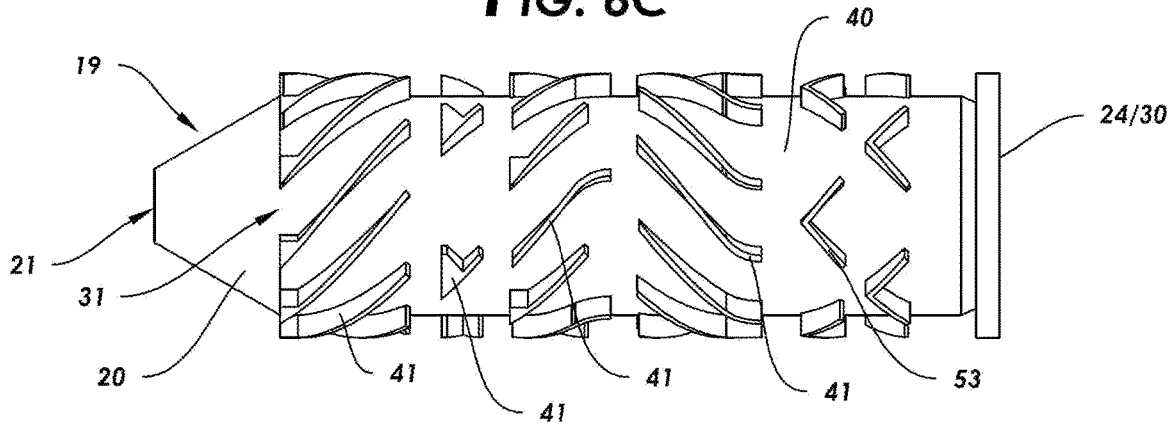
FIG. 6C is a front view of the internal portion of the particular embodiment of the suppressor shown in FIG. 5.
Figure 6D:
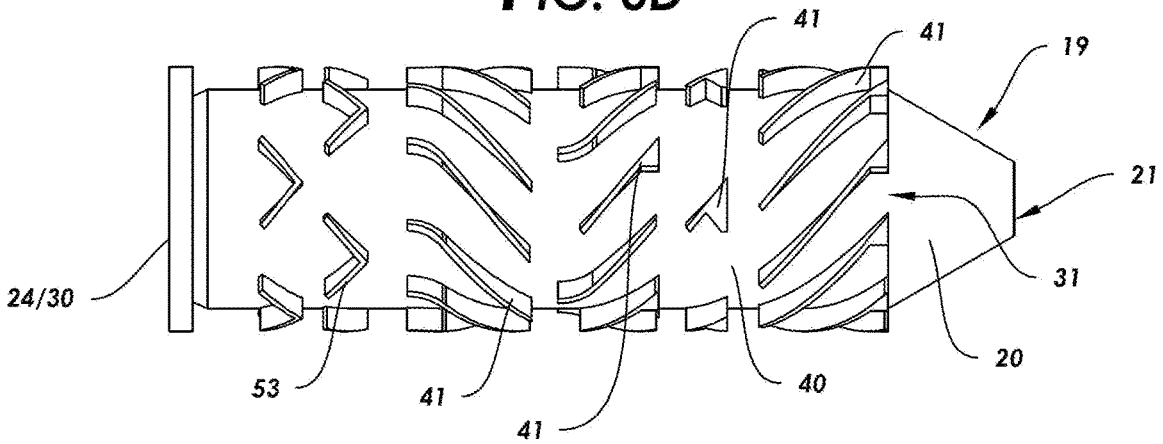
FIG. 6D is a rear view of the internal portion of the particular embodiment of the suppressor shown in FIG. 5.
Figure 6E:
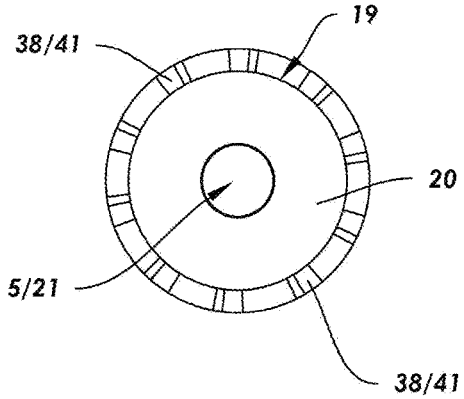
FIG. 6E is a first end view of the internal portion of the particular embodiment of the suppressor shown in FIG. 5.
Figure 6F:
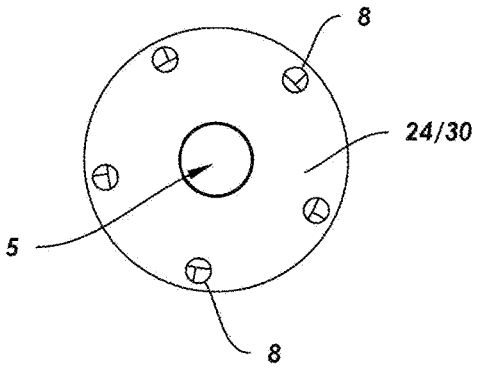
FIG. 6F is a second end view of the internal portion of the particular embodiment of the suppressor shown in FIG. 5.
Figure 6G:
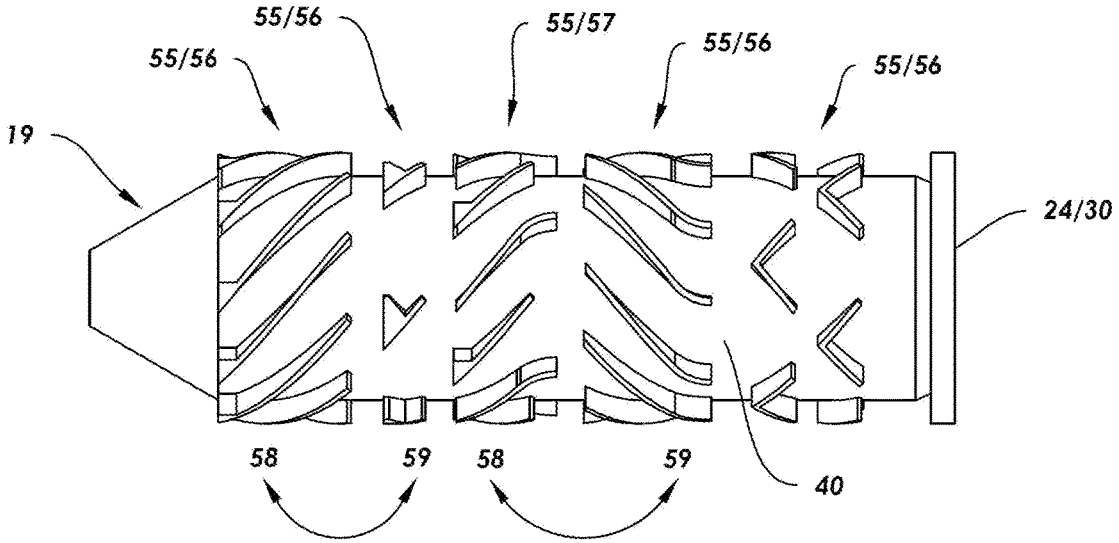
FIG. 6G is a first side view of the internal portion of the particular embodiment of the suppressor shown in FIG. 5.

Now referring primarily to FIG. 6G, as to particular embodiments, the outer chamber (4) can include a plurality of ribs (41) disposed in circumferentially spaced-apart relation within the annular space provided by the outer chamber (4) (such as wrapped about the inner chamber wall outer surface (40), body wall inner surface (39), or both), herein referred to as a circumferential rib array (55). The ribs (41) in a circumferential rib array (55) can all have the same configuration (56) or can have different configurations (57), depending upon the embodiment.

Again referring primarily to FIG. 6G, as to particular embodiments, the outer chamber (4) can include a first circumferential rib array (58) and a second circumferential rib array (59) disposed in axially spaced-apart relation within the annular space provided by the outer chamber (4), whereby the first and second circumferential rib arrays (58)(59) can have different configurations.

As to particular embodiments, the first and second circumferential rib arrays (58)(59) can differ in the rib length (43) of their ribs (41). As but one illustrative example, the first circumferential rib array (58) can comprise ribs (41) having a greater rib length (43) than the ribs (41) comprising the second circumferential array (59).

As to particular embodiments, the first and second circumferential rib arrays (58)(59) can differ in helical orientation. As but one illustrative example, the first circumferential rib array (58) can comprise ribs (41) which helically extend about the longitudinal axis in a counterclockwise direction, and the second circumferential rib array (59) can comprise ribs (41) which helically extend about the longitudinal axis in a clockwise direction.

Figure 6H:
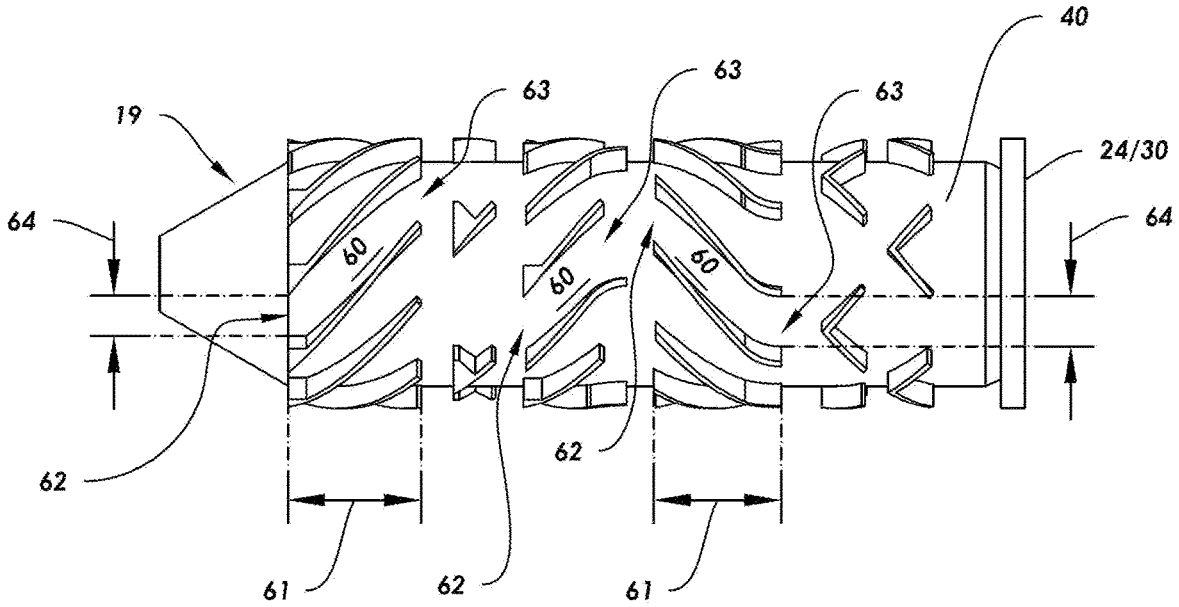
FIG. 6H is a second side view of the internal portion of the particular embodiment of the suppressor shown in FIG. 5.

Now referring primarily to FIG. 6H, as to particular embodiments, adjacent ribs (41) can define a channel (60) through which propellant gases can flow, whereby the channel (60) has a channel length (61) which extends between a channel proximal end (62) (oriented toward the outer chamber proximal end (29)) and a channel distal end (63) (oriented toward the outer chamber distal end (30)). As the ribs (41) extend helically about the longitudinal axis within the outer chamber (4), so too does the corresponding channel (60).

As to particular embodiments, the channel (60) can have a uniform channel width (64) between the channel proximal and distal ends (62)(63), whereby the uniform channel width (64) can be provided by parallel adjacent rib lateral faces (49). As to other particular embodiments, the channel (60) can have a non-uniform (or varying) channel width (64) between the channel proximal and distal ends (62)(63), whereby the non-uniform channel width (64) can be provided by non-parallel adjacent rib lateral faces (49). Regarding the latter, as to particular embodiments, the channel width (64) can be lesser proximate the channel proximal end (62), which may be provided by one of the adjacent ribs (41) having a rib proximal end face (50) with a greater rib width (44) than the remainder of the rib (41).

Example 1

Now referring primarily to FIG. 8, as but a first illustrative example (65), a circumferential rib array (55) can comprise a plurality of ribs (41), each having a linear rib length (43) between rib proximal and distal ends (45)(46) and a rib width (44) which can be greater proximate the rib proximal end (45), whereby adjacent ribs (41) define a channel (60) having a channel width (64) which can be lesser proximate said channel proximal end (62). Additionally, each rib (41) can include a vortex generator (51) proximate the rib proximal end (45).

Example 2

Again referring primarily to FIG. 8, as but a second illustrative example (66), a circumferential rib array (55) can comprise a plurality of ribs (41) disposed in an alternating configuration, whereby each rib (41) in a first rib configuration can have a linear rib length (43) between rib proximal and distal ends (45)(46) and a rib width (44) which can be greater proximate the rib proximal end (45). Additionally, each rib (41) in a first rib configuration can include a vortex generator (51) proximate the rib proximal end (45). Each rib (41) in a rib second configuration can have rib length (43) comprising a linear portion (47) and a non-linear portion (48) between the rib proximal and distal ends (45)(46), whereby the non-linear portion (48) can be proximate the rib distal end (46). Some adjacent ribs (41) can define a channel (60) having a channel width (64) which can be lesser proximate said channel proximal end (62), and other adjacent ribs (41) can define a channel (60) having a uniform channel width (64) between channel proximal and distal ends (62)(63).

Example 3

Again referring primarily to FIG. 8, as but a third illustrative example (67), a circumferential rib array (55) can comprise a plurality of ribs (41), each having a rib length (43) comprising a linear portion (47) and a non-linear portion (48) between the rib proximal and distal ends (45)(46), whereby the non-linear portion (48) can be proximate the rib distal end (46). Adjacent ribs (41) can define a channel (60) having a uniform channel width (64) between channel proximal and distal ends (62)(43).

Example 4

Again referring primarily to FIG. 8, as but a fourth illustrative example (68), a circumferential rib array (55) can comprise a plurality of ribs (41), each configured as a pair of diverging ribs (53) directed generally parallel to the longitudinal axis and pointing proximally, whereby the rib proximal ends (45) contact each other.

Of note, the configurations of the outer chamber baffles (38), including the various configurations of ribs (41), can also be employed as inner chamber baffles (32), for example in addition to or instead of one or more conical baffles or a baffle stack (36), as shown in FIG. 10.

Method of Making

Now regarding production, a method of making the instant suppressor (1) can include providing a body (3) extending along a longitudinal axis between body proximal and distal ends (9)(7), the (3) body defined by an annular body wall (10); an inner chamber (5) disposed within the body (3), the inner chamber (5) defined by an annular inner chamber wall (22); an outer chamber (4) disposed between the inner chamber wall (22) and the body wall (10), the outer chamber (4) radially surrounding the inner chamber (5); at least one inner chamber baffle (32) disposed within the inner chamber (5); and at least one outer chamber baffle (38) disposed within the outer chamber (4); wherein the inner and outer chamber baffles (32)(38) can be configured to slow the rate of expansion of the firearm's propellant gases.

The method of making particular embodiments of the suppressor (1) can further include providing additional components of the suppressor (1) as described above and in the claims.

The instant suppressor (1) can be adapted to allow fabrication of at least the entire internal portion or the entire suppressor (1) as a unitary or monolithic or continuous construct. Inner components of the suppressor (1) can be positioned so that no free-floating elements are included and all components can be continuous with surrounding components via points of contact. The suppressor (1) can thus be manufactured by 3D printing (e.g. direct metal laser sintering (DMLS), selective laser melting (SLM), fused deposition modeling (FDM), stereolithography (SLA), laminated object manufacturing (LOM), electron beam melting (EBM), etc.), permitting the suppressor (1) to be produced inclusive of all of the above described features. The 3D printing process can yield a single unitary or monolithic or continuous suppressor (1) devoid of seams, joints, welds, fittings, threads, gaps, union junctions, or any other connecting properties between the inner chamber (5), the outer chamber (4), and/or the body wall (10) other than an internal strength of the printed material itself. For example, the suppressor (1) including the inner chamber (5), the outer chamber (4), and/or the body wall (10) can be printed in one continuous process, so long as they are made of the same material. As such, the inner chamber (5), the outer chamber (4), and/or the body wall (10) of the suppressor (1) may be integrated with one another as one continuous piece.

As to other embodiments, the instant suppressor (1) can be fabricated by other methods such as casting, molding, machining, sheet stamping, welding, etc. However, by adapting the suppressor (1) to be entirely formed as a single structure by 3D printing, the manufacture of complex geometries that would be difficult or impossible to make using conventional machining techniques may be achievable. Further, the geometry of the suppressor (1) can be readily modified and tuned via 3D printing according to a specific type of firearm or effects of the suppressor (1) may be adjusted. Additionally, 3D printing can allow manufacture of the suppressor (1) from a variety of printable materials that may be chosen based on properties of the material, such as heat tolerance, durability, weight, etc.

Now regarding materials, the instant suppressor (1) can be constructed from any suitable material(s), as will be apparent in light of this disclosure. For example, as to particular embodiments, the suppressor (1) can be formed from titanium, aluminum, aluminum-cerium alloys, stainless steel, nickel, chromium-based alloys, austenitic nickel-chromium-based alloys, Inconel (an alloy of nickel containing chromium and iron, which is resistant to corrosion at high temperatures), or the like, or combinations thereof. As to particular embodiments, the suppressor (1) can be formed from a material in combination with a ceramic, which may decrease the weight and increase the strength of the material, such as a material made by Elementum 3D located in Erie, Colorado, USA. It may be desirable in some instances to ensure that the suppressor (1) comprises a material (or combination of materials), for example, that is corrosion resistant, retains strength over a large temperature range (e.g., in the range of about −50° F. to 1200° F.), and/or is resistant to deformation and/or fracture at high pressures (e.g., 600 psi to 650 psi throughout and over 1000 psi in localized areas). In a more general sense, embodiments of the suppressor (1) can be constructed from any suitable material which is compliant, for example, with United States Defense Standard MIL-W-13855 (Weapons: Small Arms and Aircraft Armament Subsystems, General Specification For). Other suitable materials for the suppressor (1) will depend on a given application and will be apparent in light of this disclosure.

As will be appreciated, the particular configuration (e.g., materials, dimensions, etc.) of the instant suppressor (1) can be varied, for example, depending on whether the target application or end-use is military, law enforcement, or civilian in nature.

Figure 9:
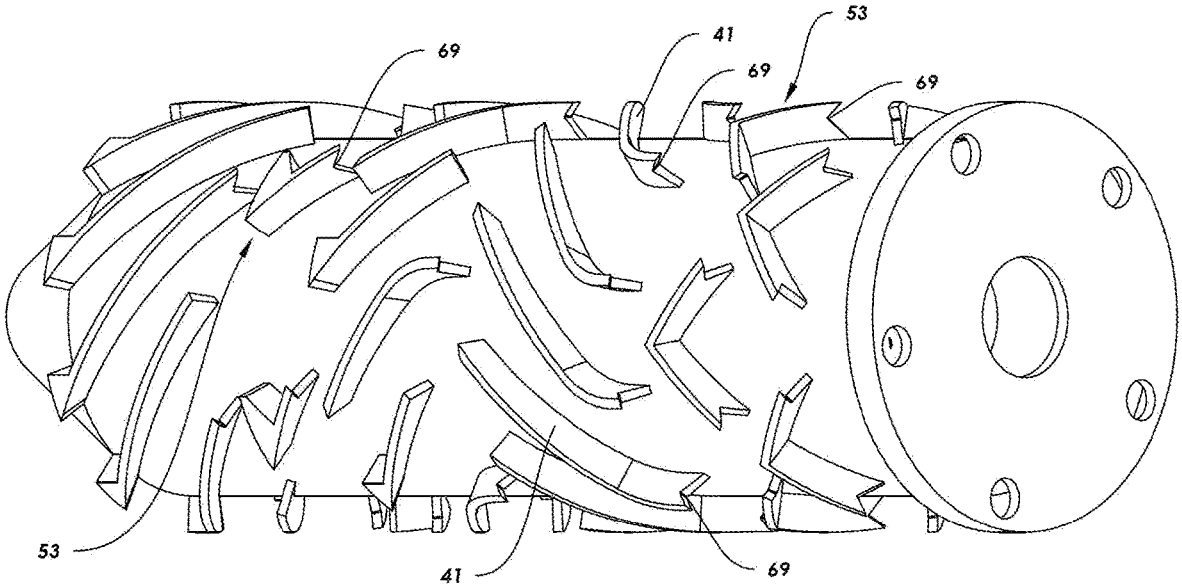
FIG. 9 is a perspective view of the internal portion of a particular embodiment of the inventive suppressor.

Now referring primarily to FIG. 9, as to particular embodiments, ribs (41) can include a V-shaped end portion (69). As to particular embodiments, the V-shape may not be required and can be the result of additive manufacturing techniques (e.g., DMLS). Although not mandatory, the V-shape may be useful to provide for addition propellant gas diversion.

As can be easily understood from the foregoing, the basic concepts of the present invention may be embodied in a variety of ways. The invention involves numerous and varied embodiments of a suppressor for a firearm and methods for making and using such a suppressor.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "a suppressor" should be understood to encompass disclosure of the act of "suppressing"—whether explicitly discussed or not—and, conversely, were there effectively disclosure of the act of "suppressing", such a disclosure should be understood to encompass disclosure of "suppressing" and even a "means for suppressing." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

Moreover, for the purposes of the present invention, the term "a" or "an" entity refers to one or more of that entity; for example, "a baffle" refers to one or more of those baffles. As such, the terms "a" or "an", "one or more" and "at least one" can be used interchangeably herein.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment.

As used herein with respect to an identified property or circumstance, "substantially" refers to a degree of deviation that is sufficiently small so as to not measurably detract from the identified property or circumstance. The exact degree of deviation allowable may in some cases depend on the specific context.

Thus, the applicant(s) should be understood to claim at least: i) each of the suppressors herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A suppressor for a firearm, the suppressor comprising:

a body extending along a longitudinal axis between body proximal and distal ends, said body defined by an annular body wall;

an inner chamber disposed within said body, said inner chamber defined by an annular inner chamber wall;

an outer chamber disposed between said inner chamber wall and said body wall, said outer chamber radially surrounding said inner chamber;

at least one inner chamber baffle disposed within said inner chamber; and at least one outer chamber baffle disposed within said outer chamber;

wherein said inner and outer chamber baffles are configured to slow the rate of expansion of said firearm's propellant gases, wherein said outer chamber baffle is disposed between said inner chamber wall and said body wall, wherein said outer chamber baffle comprises a rib having a rib height which radially extends between said inner chamber wall and said body wall, wherein said rib comprises a rib length extending between rib proximal and distal ends, wherein said rib comprises a rib width extending between rib lateral faces, wherein said rib width varies along said rib length.

2. The suppressor of claim 1, wherein said inner chamber and said outer chamber are fluidically isolated from one another along their lengths by said inner chamber wall.

3. The suppressor of claim 1, wherein said rib length extends helically about said longitudinal axis within said outer chamber.

4. The suppressor of claim 1, wherein said rib length extends helically within an annular space provided by said outer chamber between outer chamber proximal and distal ends.

5. The suppressor of claim 1, wherein said rib length extends both circumferentially and axially within said outer chamber.

6. The suppressor of claim 5, wherein said rib length extends only partially about a circumference of said inner chamber wall.

7. The suppressor of claim 5, wherein said rib length extends only partially along an outer chamber length of said outer chamber.

8. The suppressor of claim 5, wherein said rib length is entirely linear between said rib proximal and distal ends.

9. The suppressor of claim 5, wherein said rib length comprises linear and non-linear portions between said rib proximal and distal ends.

10. The suppressor of claim 1, wherein a rib proximal end face has a greater width than the remainder of said rib.

11. The suppressor of claim 10, wherein said rib proximal end face is disposed in angled relation to said longitudinal axis.

12. The suppressor of claim 11, wherein said rib proximal end face is disposed in substantially transverse relation to said longitudinal axis.

13. The suppressor of claim 1, wherein said rib comprises a vortex generator configured as two adjacent faces of said rib disposed in angled relation to one another to create a vortex-generating pocket therebetween.

14. The suppressor of claim 1, wherein said outer chamber comprises a circumferential rib array comprising a plurality of ribs disposed in circumferentially spaced-apart relation within an annular space provided by said outer chamber.

15. The suppressor of claim 14, wherein said circumferential rib array comprises first and second portions of said circumferential rib array, said first and second portions of said circumferential rib array being disposed in axially spaced-apart relation to each other.

16. A suppressor for a firearm, the suppressor comprising:

a body extending along a longitudinal axis between body proximal and distal ends, said body defined by an annular body wall;

an inner chamber disposed within said body, said inner chamber defined by an annular inner chamber wall;

an outer chamber disposed between said inner chamber wall and said body wall, said outer chamber radially surrounding said inner chamber;

at least one inner chamber baffle disposed within said inner chamber; and at least one outer chamber baffle disposed within said outer chamber;

wherein said outer chamber baffle is disposed between said inner chamber wall and said body wall, wherein said outer chamber baffle comprises a rib having proximal and distal ends, said distal end of said rib being displaced both circumferentially and axially from said proximal end of said rib, thereby defining a length of said rib, and wherein said proximal end of said rib is thicker than said distal end of said rib such that a vortex-generating pocket is formed between said proximal and distal ends of said rib.

17. A suppressor for a firearm, the suppressor comprising:

a body extending along a longitudinal axis between body proximal and distal ends, said body defined by an annular body wall;

an inner chamber disposed within said body, said inner chamber defined by an annular inner chamber wall;

an outer chamber disposed between said inner chamber wall and said body wall, said outer chamber radially surrounding said inner chamber;

a first circumferential rib array extending along a first longitudinal portion of the body; and a second circumferential rib array extending along a second longitudinal portion of the body;

wherein each rib of said first circumferential rib array extends axially and circumferentially, thereby forming a plurality of angled channels for directing propellant gasses in a first twisting direction, wherein each rib of said second circumferential rib array extends axially and circumferentially, thereby forming a plurality of angled channels for directing propellant gasses in a second twisting direction, the second twisting direction being opposed to the first twisting direction.

18. The suppressor of claim 17, wherein said second circumferential rib array is displaced axially downstream of said first circumferential rib array, thereby forming a void between said first and second rib arrays, the void being configured to facilitate mixing of propellant gasses from adjacent angled channels of said first circumferential rib array prior to the mixed propellant gasses being redirected by the second circumferential rib array.

19. The suppressor of claim 18, further comprising:

a third circumferential rib array positioned upstream of said first circumferential rib array, said third circumferential rib array forming a plurality of angled channels for directing propellant gasses towards said first circumferential rib array, wherein said third circumferential rib array is displaced axially from said first circumferential rib array, thereby forming a void between said first and third rib arrays, the void being configured to facilitate mixing of propellant gasses from adjacent angled channels of said third circumferential rib array prior to the mixed propellant gasses moving into the angled channels of said first circumferential rib array; and a plurality of circumferentially spaced protrusions positioned within the void between the first and third rib arrays, the circumferentially spaced protrusions being positioned between respective angled channels of said first and third rib arrays, thereby inhibiting direct flow of propellant gasses from said third rib array to said first rib array.

20. The suppressor of claim 19, further comprising:

a first group of circumferentially spaced diverging rib pairs positioned downstream of said second rib array, each diverging rib pair of said first group of circumferentially spaced diverging rib pairs forming a V-shape, thereby redirecting at least a portion of the propellant gasses exiting the second rib array; and a second group of circumferentially spaced diverging rib pairs positioned downstream of said first group of circumferentially spaced diverging rib pairs, each diverging rib pair of said second group of circumferentially spaced diverging rib pairs forming a V-shape and being offset circumferentially from corresponding rib pairs of said first group of circumferentially spaced diverging rib pairs, thereby redirecting at least a portion of the propellant gasses exiting the first group of circumferentially spaced diverging rib pairs.

* * * * *